US007826770B2

(12) United States Patent
Wing et al.

(10) Patent No.: US 7,826,770 B2
(45) Date of Patent: Nov. 2, 2010

(54) PRINTING APPARATUS AND METHOD

(75) Inventors: Joseph M. Wing, Ontario, NY (US); Brian R Conrow, Webster, NY (US); Robert Edward Hildebrand, Macedon, NY (US); Brian J. Perry, Honeoye, NY (US); Alan G. Schlageter, Ontario, NY (US); Shawn Updegraff, Fairport, NY (US); Moritz P. Wagner, Walworth, NY (US); R. Enrique Viturro, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 912 days.

(21) Appl. No.: 11/702,238

(22) Filed: Feb. 5, 2007

(65) Prior Publication Data

US 2008/0187335 A1 Aug. 7, 2008

(51) Int. Cl.
*G03G 15/00* (2006.01)

(52) U.S. Cl. ..... 399/162; 399/225

(58) Field of Classification Search ..... 399/162, 399/225, 302, 308, 309, 364, 34, 49
See application file for complete search history.

(56) References Cited

U.S. PATENT DOCUMENTS

| | | | | |
|---|---|---|---|---|
| 4,761,671 | A * | 8/1988 | Sadowski et al. | 399/343 |
| 5,276,485 | A * | 1/1994 | Osbourne et al. | 399/164 |
| 5,903,797 | A * | 5/1999 | Daniels et al. | 399/34 |
| 5,946,533 | A * | 8/1999 | Omelchenko et al. | 399/223 |
| 6,272,295 | B1 * | 8/2001 | Lindblad et al. | 399/26 |
| 6,775,512 | B2 * | 8/2004 | Thayer | 399/353 |
| 7,561,834 | B2 * | 7/2009 | Silence | 399/258 |

OTHER PUBLICATIONS

U.S. Appl. No. 11/531,016, Sep. 12, 2006, Wing et al.

* cited by examiner

*Primary Examiner*—David M Gray
*Assistant Examiner*—Barnabas T Fekete
(74) *Attorney, Agent, or Firm*—Fay Sharpe LLP

(57) ABSTRACT

Disclosed is a printing apparatus and method to correct for image non-uniformities. The printing apparatus comprises a photoreceptor (P/R) belt charging device positioned to charge the P/R belt after an image is transferred to a media sheet. Subsequently, an image sensing device scans the P/R belt residual image or patches to detect image non-uniformities.

18 Claims, 2 Drawing Sheets

PRINTING APPARATUS AND METHOD

CROSS REFERENCE TO RELATED PATENTS AND APPLICATIONS

U.S. Pat. No. 5,946,533, by Omelchenko et al. issued Aug. 31, 1999, entitled "PRINTING MACHINE ARCHITECTURE"; and U.S. patent application Ser. No. 11/531,016, by Joseph Wing et al., filed Sep. 12, 2006, entitled "SENSOR MODULE DOCKING ARRANGEMENT WITH MULTIPLE DEGREES OF FREEDOM CONSTRAINT" and are totally incorporated by reference.

BACKGROUND

This disclosure relates to a printing apparatus and method. Specifically, the disclosed printing apparatus and method relate to scanning a P/R (Photoreceptor Belt) for image non-uniformities and controlling the printing process to reduce or correct the image non-uniformities.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the image contained within the original document. After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to a sheet. Thereafter, pressure and heat are applied to the toner image to fuse the toner image to the sheet.

It is highly desirable to use an electrophotographic printing machine of this type to produce color prints. In order to produce a color print, the printing machine includes a plurality of stations. Each station has a charging device for charging the photoconductive surface, an exposing device for selectively illuminating the charged portions of the photoconductive surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image. The resultant multi-color powder image is subsequently transferred to a sheet. The transferred multi-color image is then permanently fused to the sheet forming the color print.

Cross-process non-uniformities, commonly referred to as streaks, can be a significant factor effecting the overall quality of a printed media sheet, for example a printed cut-sheet. Conventional printing technologies contain several sources of streaks which cannot be satisfactorily controlled via printer design or printing system optimization.

One current approach to correct for streaks is a service tool. The service tool provides correction of stable sources of spatial low-frequency non-uniformities in prints, such as the raster output system (ROS) fast-scan spot size profile. A printed image non-uniformity is scanned or sensed using an offline spectrophotometer connected to a Portable Work Station (PWS). Image corrections are controlled by a ROS intensity profile via a rolloff correction curve. This system and method of image correction is successful for some non-uniformities. However, time-varying and/or narrow streaks cannot always be controlled/corrected using this offline technique.

BRIEF DESCRIPTION

A printing apparatus comprising a P/R (Photoreceptor) belt; one or more image recording stations arranged to transfer one or more images to the P/R belt; an image transfer station arranged to transfer an image from the P/R belt to a media sheet; a P/R belt charging device positioned to charge the P/R belt after an image is transferred to a media sheet; and an image sensing device to sense images associated with the P/R belt, the image sensing device positioned to scan the P/R belt image after the P/R belt is charged by the P/R belt charging device.

A method of controlling image non-uniformities associated with a printing apparatus P/R belt, the method comprising transferring an image from one or more image recording stations to the P/R belt; transferring the image from the P/R belt to a media sheet; negatively charging the P/R belt and residual image associated with the P/R belt; using a full width array sensor to scan the P/R belt residual image; and adjusting one or more image recording stations to reduce image non-uniformities associated with the P/R belt.

A xerographic apparatus comprising a P/R belt; one or more image recording stations operatively coupled to the P/R belt; an image transfer station operatively coupled to the P/R belt and adapted to transfer an image from the P/R belt to a media sheet; a P/R belt pre-clean dicorotron adapted to negatively charge the P/R belt after the pre-clean magnet positively charges the P/R belt; and a full width array sensor operatively coupled to the P/R belt image after the P/R belt is negatively charged by the pre-clean dicorotron.

DETAILED DESCRIPTION

Figure 1:
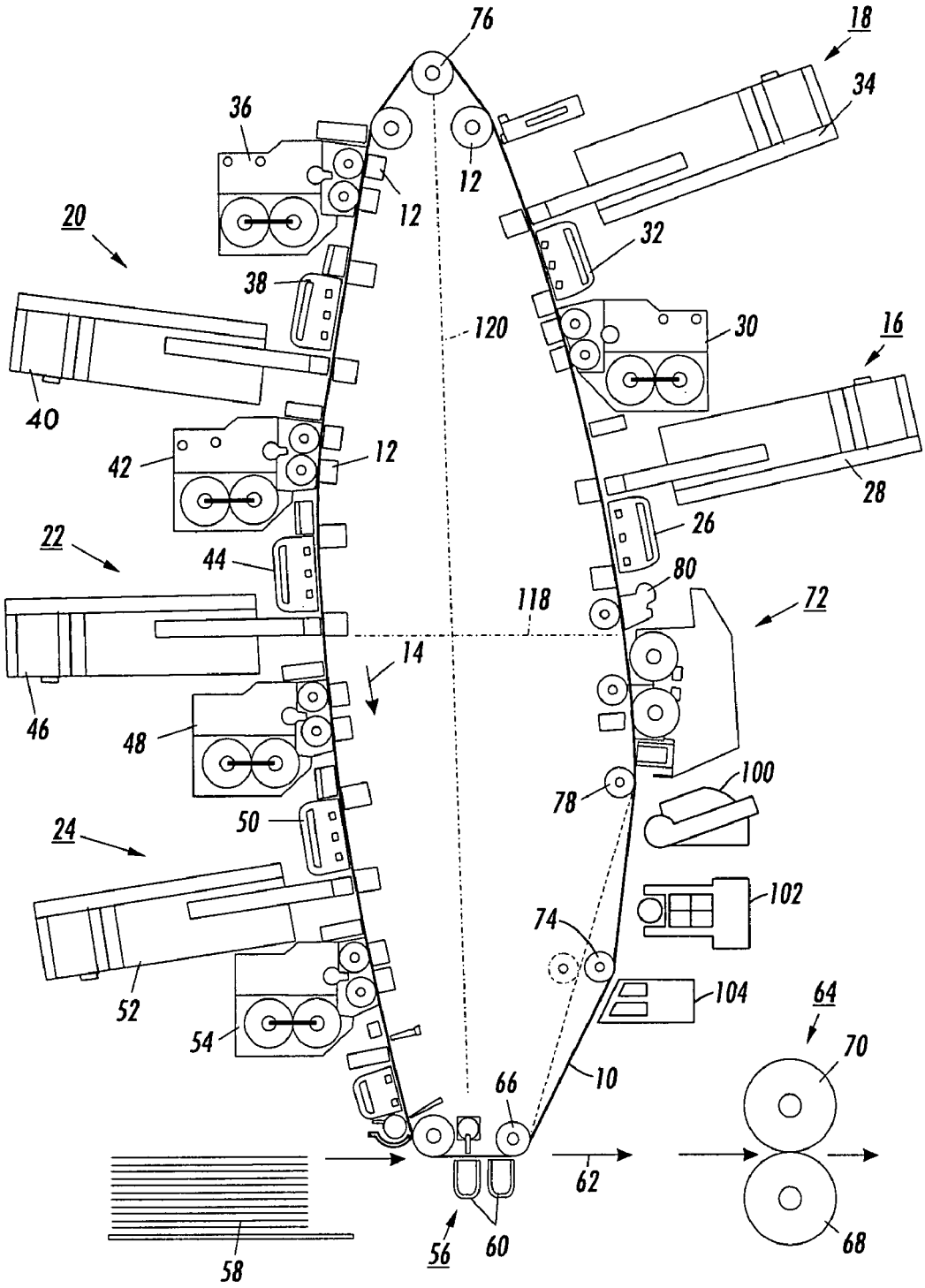
FIG. 1 illustrates a printing apparatus according to an exemplary embodiment of this disclosure.

With reference to FIG. 1, illustrated is a printing apparatus according to an exemplary embodiment of this disclosure. The printing apparatus comprises a FWA sensor 100 to scan for image non-uniformities (i.e. streaks) associated with a P/R belt 10. Subsequent to image scanning, FWA detected non-uniformities are corrected by the application of spatial Tone Reproduction Curves (TRC), for example in a Contone Rendering Module (CRM). By way of additional background, a TRC is one approach to calibrate an electrophotographic printing apparatus. A TRC is a continuous curve or representation thereof, which plots input color values versus a specific output colorant value to produce a desired rendered intensity for a specific colorant.

With continuing reference to FIG. 1, shown is a single pass multi-color printing machine. This printing machine employs a photoconductive/photoreceptor belt 10 supported by a plurality of rollers or bars 12. P/R belt 10 is arranged in a vertical orientation. P/R belt 10 advances in the direction of arrow 14 to move successive portions of the external surface of P/R belt 10 sequentially beneath the various processing stations disposed about the path of movement thereof. The P/R belt has a major axis 120 and a minor axis 118. The major and minor axes are perpendicular to one another. P/R belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of P/R belt 10, belt 10 continues to advance in the direction of arrow 14 to image recording station 18.

Image recording station 18 includes a recharging device and an exposure device. The charging device includes a corona generator 32 which recharges the exterior surface of P/R belt 10 to a relatively high, substantially uniform potential. The exposure device includes a ROS 34 which illuminates the charged portion of the exterior surface of P/R belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of P/R belt 10. After the magenta toner powder image has been developed on the exterior surface of P/R belt 10, P/R belt 10 continues to advance in the direction of arrow 14 to image recording station 20.

Image recording station 20 includes a charging device and an exposure device. The charging device includes corona generator 38 which recharges the photoconductive surface to a relatively high, substantially uniform potential. The exposure device includes ROS 40 which illuminates the charged portion of the exterior surface of P/R belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of P/R belt 10 to form a yellow toner powder image thereon. After the third electrostatic latent image has been developed with yellow toner, belt 10 advances in the direction of arrow 14 to the next image recording station 22.

Image recording station 22 includes a charging device and an exposure device. The charging device includes a corona generator 44 which charges the exterior surface of photoconductive belt 10 to a relatively high, substantially uniform potential. The exposure device includes ROS 46, which illuminates the charged portion of the exterior surface of P/R belt 10 to selectively dissipate the charge on the exterior surface of P/R belt 10 to record a fourth electrostatic latent image for development with cyan toner particles. After the fourth electrostatic latent image is recorded on the exterior surface of P/R belt 10, P/R belt 10 advances this electrostatic latent image to the cyan developer unit 48.

Cyan developer unit 48 deposits cyan toner particles on the fourth electrostatic latent image. These toner particles may be partially superimposed and registered with the previously formed yellow powder image. After the cyan toner powder image is formed on the exterior surface of P/R belt 10, P/R belt 10 advances to the next image recording station 24.

Image recording station 24 includes a charging device and an exposure device. The charging device includes corona generator 50 which charges the exterior surface of P/R belt 10 to a relatively high, substantially uniform potential. The exposure device includes ROS 52, which illuminates the charged portion of the exterior surface of P/R belt 10 to selectively discharge those portions of the charged exterior surface of P/R belt 10 which are to be developed with black toner particles. The fifth electrostatic latent image, to be developed with black toner particles, is advanced to black developer unit 54.

At black developer unit 54, black toner particles are deposited on the exterior surface of P/R belt 10. These black toner particles form a black toner powder image which may be partially or totally superimposed and registered with the previously formed yellow and magenta toner powder images. In this way, a multi-color toner powder image is formed on the exterior surface of P/R belt 10. Thereafter, P/R belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the back side of the paper. This attracts the developed multi-color toner image from the exterior surface of P/R belt 10 to the sheet of paper. Stripping assist roller 66 contacts the interior surface of P/R belt 10 and provides a sufficiently sharp bend thereat so that the beam strength of the advancing paper strips from P/R belt 10. A vacuum transport moves the sheet of paper in the direction of arrow 62 to fusing station 64.

Fusing station 64 includes a heated fuser roller 70 and a backup roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multicolor developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Other features of the printing apparatus illustrated in FIG. 1 include an image sensing device 100, a pre-clean dicorotron 102, and a pre-clean magnet 104. The arrangement of these devices within the printing apparatus provides a means for sensing image non-uniformities associated with the P/R belt which are representative of image non-uniformities transferred to a media sheet at transfer station 56.

In operation, the pre-clean magnet 104 collects stray carrier beads from the positively charged P/R belt. Next, a P/R belt charging device, for example a dicorotron 102, charges the PIR belt 10 and residual image to a substantially negative potential. The image sensing device 100, for example a full width array (FWA) sensor, scans the negatively charged P/R belt 10 for residual image non-uniformities as the P/R belt passes. Subsequent to this image sensing operation, the P/R belt is cleaned by the cleaning station 72 which attracts the negatively charged toner particles with a positive charge.

Notably, the relative placement of the image sensing device 100 within the P/R belt cleaning configuration provides satisfactory cleaning of the P/R belt 10 and satisfactory image sensing of the P/R belt residual image for further processing. Substantively, this dual processing function is accomplished by negatively charging the P/R belt residual image prior to image sensing the P/R belt residual image. Image sensing is accomplished without significantly disturbing the substantively negatively charged toner particles which are subsequently removed with a positively charged device at cleaning station 72. This relative arrangement helps to reduce ghosting problems.

Further processing of the residual image data acquired by the image sensing device 100 controls image recording stations 16, 18, 20, 22 and 24 by applying spatial Tone Reproduction Curves (TRC) to correct for image non-uniformities, i.e. streaks. This may be accomplished via a controller and/or a Contone Rendering Module (CRM).

A further refinement to the printing apparatus described with reference to FIG. 1, includes the transfer of patches to the P/R belt 10 by one or more of the image recording stations 16, 18, 20, 22 and 24. The patches are transferred to the P/R belt within inter-print zones. These inter-print zones are areas of the P/R belt 10 between consecutive images which are ultimately transferred to consecutive media sheets. The image sensing device 100 scans the patches, not the P/R belt residual image, for further processing to control image non-uniformities. Furthermore, the transferred patches may include a set of patches where each patch is associated with a different toner color or combination of toner colors (i.e. overlays including multiple toner layers).

Figure 2:
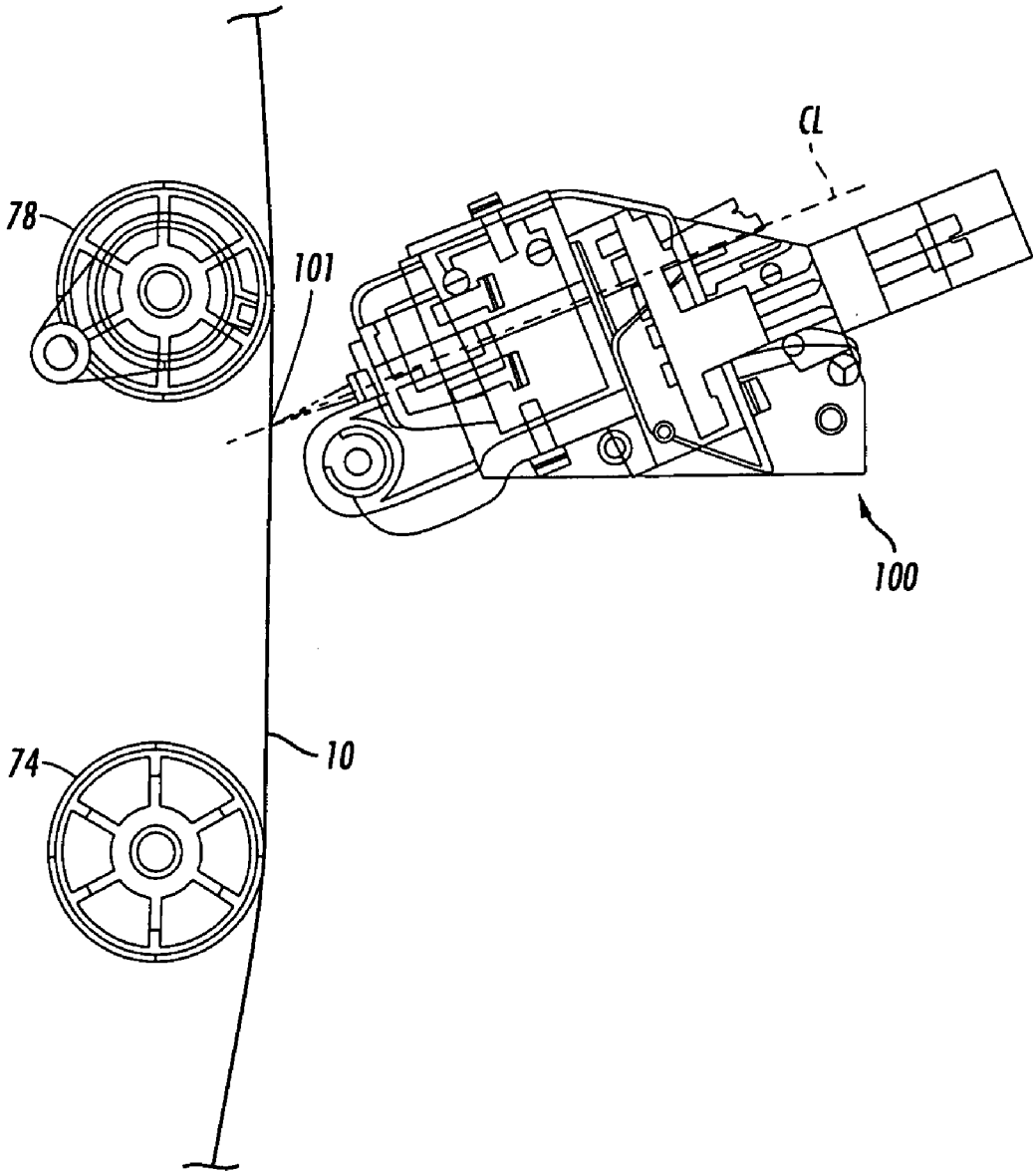
FIG. 2 illustrates an image sensing device according to an exemplary embodiment of this disclosure.

With reference to FIG. 2, illustrated is an image sensing device 100 according to an exemplary embodiment of this disclosure. The image sensing device comprises a full width array sensor (FWA) 100 proximately located to the P/R belt 10, an isolation roll 74 and a backup roll 240. For optimal control of the FWA 100, the focal point 101 or center line (CL) of the FWA 100 can be controlled or adjusted. According to one exemplary embodiment, the focal point 101 of the FWA sensor lens center line CL is positioned at an angle of 22.5±1.5° relative to the P/R belt 10.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing apparatus comprising:

a P/R (Photoreceptor) belt;

one or more image recording stations arranged to transfer one or more images to the P/R belt;

an image transfer station arranged to transfer the one or more images from the P/R belt to a media sheet;

a P/R belt charging device positioned to charge the P/R belt after the one or more images are transferred to a media sheet;

an image sensing device to sense images associated with the P/R belt, the image sensing device positioned to scan the P/R belt image after the P/R belt is charged by the P/R belt charging device; and a P/R belt cleaner positioned to remove the images associated with the P/R belt after the image sensing device scans the images associated with the P/R belt.

2. The printing apparatus according to claim 1, the P/R belt charging device comprising:

a dicorotron device to negatively charge the P/R belt.

3. The printing apparatus according to claim 1, the P/R belt charging device comprising:

a pre-clean magnet adapted to collect stray carrier beads from the P/R belt; and a pre-clean dicorotron adapted to negatively charge the P/R belt after the pre-clean magnet collects stray carrier beads from the P/R belt.

4. The printing apparatus according to claim 1, wherein the P/R belt cleaner removes the image associated with the P/R belt by attracting the negatively charged image particles with a positive charge.

5. The printing apparatus according to claim 1, the image sensing device comprising a full width array sensor.

6. The printing apparatus according to claim 1, wherein the printing apparatus is configured to apply spatial Tone Reproduction Curves to reduce image non-uniformities detected by the image sensing device.

7. The printing apparatus according to claim 1, further comprising:

a controller operatively connected to the image sensing device and the one or more image recording stations, wherein the controller applies spatial Tone Reproduction Curves to reduce image non-uniformities associated with the P/R belt.

8. The printing apparatus according to claim 1, wherein the printing apparatus is configured to transfer one or more patches to the P/R belt and the image sensing device scans the one or more patches to detect non-uniformities associated with the patches.

9. The printing apparatus according to claim 8, wherein the one or more patches includes a plurality of patches where each patch is associated with a different color.

10. The printing apparatus according to claim 8, wherein the one or more patches comprise overlays.

11. A method of controlling image non-uniformities associated with a printing apparatus P/R belt, the method comprising:

transferring an image from one or more image recording stations to the P/R belt;

transferring the image from the P/R belt to a media sheet;

negatively charging the P/R belt and a residual image associated with the P/R belt;

scanning the P/R belt residual image using a full width array sensor;

adjusting one or more image recording stations to reduce image non-uniformities associated with the P/R belt; and removing the residual image associated with the P/R belt after the full width array sensor scans the P/R belt residual image.

12. The method of controlling image non-uniformities according to claim 11, further comprising:

pre-cleaning the P/R belt with a magnet after an image is transferred to a media sheet and before the P/R belt is negatively charged.

13. The method of controlling image non-uniformities according to claim 12, wherein the P/R belt is negatively charged with a dicorotron.

14. The method of controlling image non-uniformities according to claim 13, wherein the P/R belt is positively charged prior to the P/R belt being negatively charged.

15. The method of controlling image non-uniformities according to claim 12, further comprising:

transferring one or more patches from one or more image recording stations to the P/R belt;

using the full width array sensor to scan the P/R belt patches; and adjusting the one or more image recording stations to reduce image non-uniformities associated with the P/R belt patches.

16. The method of controlling image non-uniformities according to claim 15, wherein the one or more patches comprises overlays.

17. The method of controlling image non-uniformities according to claim 15, further comprising:

applying Tone Reproduction Curves to adjust the one or more image recording stations to reduce image non-uniformities associated with the P/R belt patches.

18. A xerographic apparatus comprising:

a P/R belt;

one or more image recording stations operatively coupled to the P/R belt;

an image transfer station operatively coupled to the P/R belt and adapted to transfer an image from the P/R belt to a media sheet;

a P/R belt pre-clean dicorotron adapted to negatively charge the P/R belt after a pre-clean magnet positively charges the P/R belt;

a full width array sensor operatively coupled to the P/R belt image after the P/R belt is negatively charged by the pre-clean dicorotron, the full width array sensor configured to sense images associated with the P/R belt; and a P/R belt cleaner positioned to remove the image associated with the P/R belt after the full width array sensor senses the image associated with the P/R belt.

* * * * *